US008525622B2

(12) United States Patent
Kubono

(10) Patent No.: US 8,525,622 B2
(45) Date of Patent: Sep. 3, 2013

(54) ELECTROMAGNETIC RELAY

(75) Inventor: Kazuo Kubono, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/087,688

(22) Filed: Apr. 15, 2011

(65) Prior Publication Data

US 2011/0254645 A1 Oct. 20, 2011

(30) Foreign Application Priority Data

Apr. 16, 2010 (JP) ..... 2010-095257

(51) Int. Cl.
*H01H 51/22* (2006.01)

(52) U.S. Cl.
USPC ..... 335/78; 335/199

(58) Field of Classification Search
USPC ..... 335/78–86, 127–130, 197, 199
See application file for complete search history.

(56) References Cited

U.S. PATENT DOCUMENTS 3,878,489 A * 4/1975 Rothweiler ..... 335/199
4,400,761 A * 8/1983 Hayden et al. ..... 361/782
4,529,952 A * 7/1985 Nagamoto et al. ..... 335/81
6,081,176 A * 6/2000 Dittmann et al. ..... 335/128
6,204,740 B1 * 3/2001 Nakahata ..... 335/4
7,190,246 B2 * 3/2007 Angle et al. ..... 335/128
7,782,162 B2 * 8/2010 Nishida ..... 335/201
8,169,280 B2 * 5/2012 Saruwatari et al. ..... 335/78
2010/0066468 A1 * 3/2010 Iwamoto et al. ..... 335/128

FOREIGN PATENT DOCUMENTS

CN 101297384 A 10/2008
JP 2010-073323 4/2010

* cited by examiner

*Primary Examiner* — Bernard Rojas
(74) *Attorney, Agent, or Firm* — Staas & Halsey LLP

(57) ABSTRACT

An electromagnetic relay including an electromagnet device having an electromagnet and an armature, a contact portion openable and closable according to a movement of the armature. The contact portion includes a plurality of fixed contact members in which fixed contacts are respectively arranged and a plurality of movable contact members in which movable contacts opposed to the fixed contacts are respectively arranged, wherein the plurality of movable contact members operate according to a movement of the armature. The electromagnetic relay further includes a printed board to which the plurality of fixed contact members and the plurality of movable contact members are respectively electrically connected, and a plurality of contact terminal members electrically connected to the printed board and adapted to be connected to electrical parts provided outside.

7 Claims, 10 Drawing Sheets

ELECTROMAGNETIC RELAY

BACKGROUND OF THE INVENTION

1. Field of the Invention

The present invention relates to an electromagnetic relay.

2. Description of the Related Art

There is a known electromagnetic relay which includes an electromagnet in which an iron core is attached to a bobbin having a coil; an armature moved according to voltage applied to the coil; and a contact portion openable and closable according to a movement of the armature, wherein the contact portion has a pair of fixed contacts and a pair of movable contacts opposed to the pair of fixed contacts. In the electromagnetic relay described in Japanese Unexamined Patent Publication (kokai) No. 2010-73323 (JP2010-73323A), movable contacts are provided at both end portions of an conductive plate, and when each movable contact is contacted to each fixed contact at the time of operation of the electromagnetic relay, the fixed contacts are electrically connected to each other in series through the movable contacts.

However, in this type of electromagnetic relay, fixed contacts are arranged at one end portion of a pair of plate-shaped fixed contact members and movable contacts are arranged at one end portion of a pair of movable contact members and further terminals are arranged at the other end portion. Therefore, it is difficult to change the terminal arrangement.

SUMMARY OF THE INVENTION

The present invention provides an electromagnetic relay comprising an electromagnet device having an electromagnet in which an iron core is attached to a bobbin with a coil wound thereon, and an armature attracted to or separated from the iron core according to voltage applied to the coil; a contact portion openable and closable according to a movement of the armature, the contact portion including a plurality of fixed contact members in which fixed contacts are respectively arranged and a plurality of movable contact members in which movable contacts opposed to the fixed contacts are respectively arranged, wherein the plurality of movable contact members operate according to a movement of the armature; a printed board to which the plurality of fixed contact members and the plurality of movable contact members are respectively electrically connected; and a plurality of contact terminal members electrically connected to the printed board and adapted to be connected to electrical parts provided outside.

BRIEF DESCRIPTION OF THE DRAWINGS

The object, features and advantages of the present invention will become more apparent from the following description of embodiments taken in conjunction with the accompanying drawings, in which:

FIG. 6 is a view of the printed board taken from the upside;

DETAILED DESCRIPTION

Figure 1:
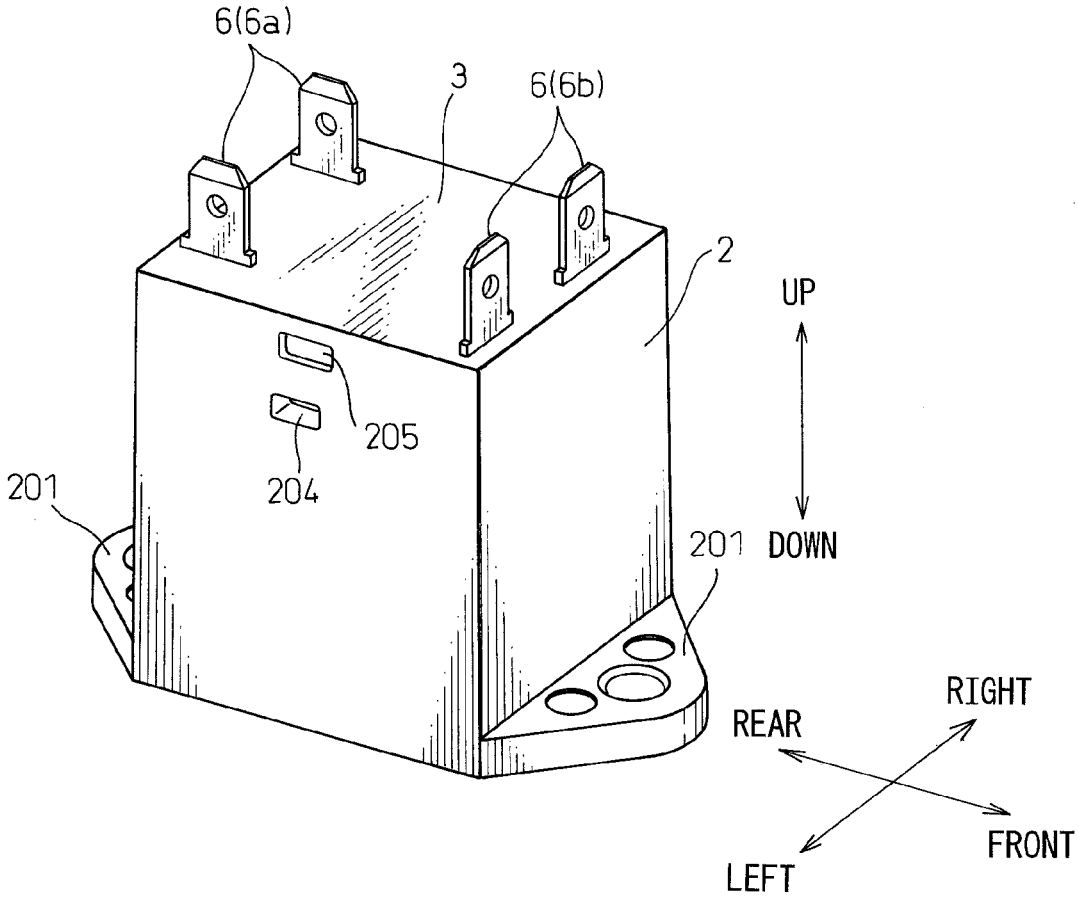
FIG. 1 is a perspective view showing an appearance configuration of the electromagnetic relay according to the embodiment of the present invention.
Figure 2:
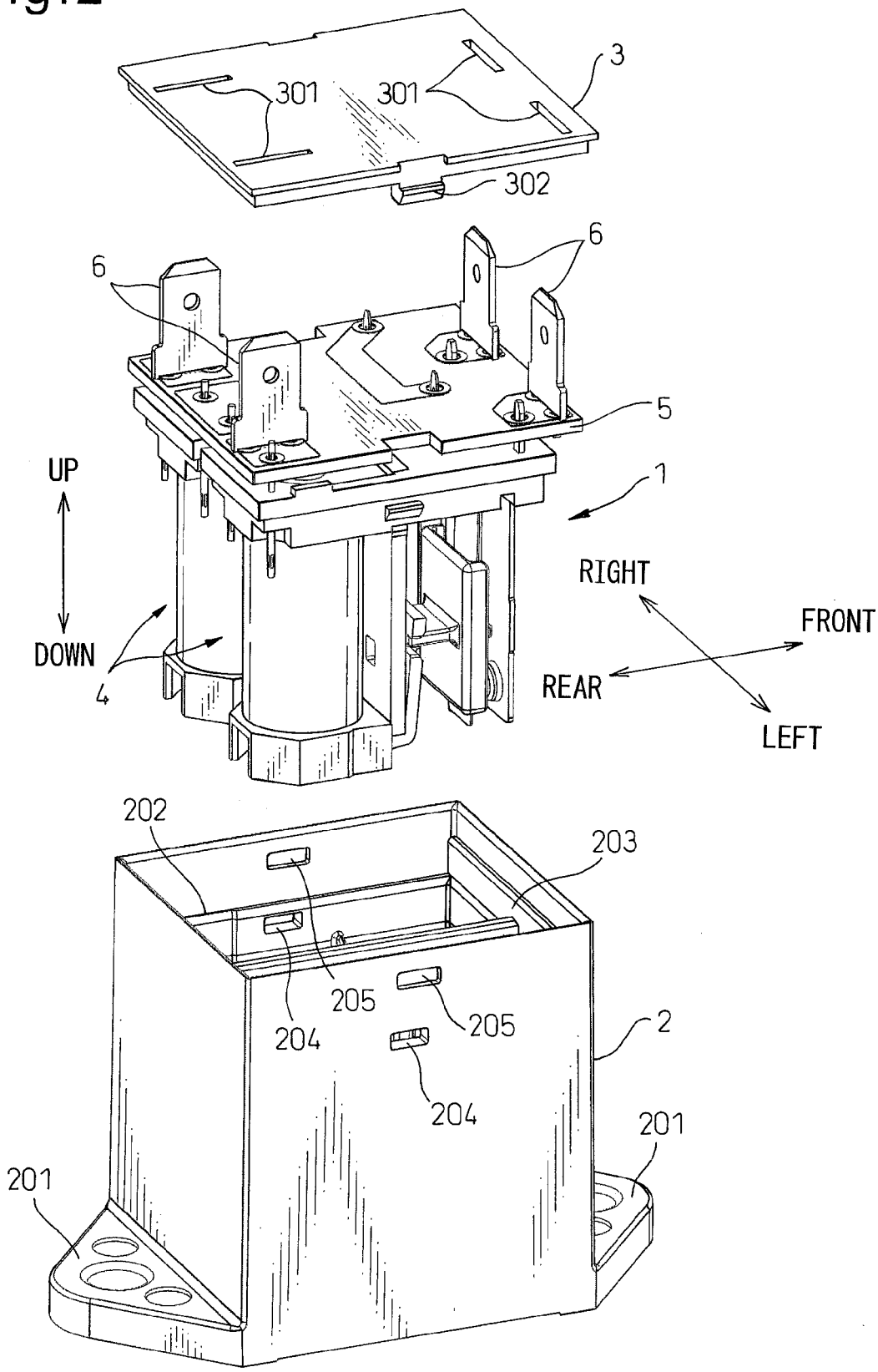
FIG. 2 is an exploded perspective view of the electromagnetic relay shown in FIG. 1.

Referring to FIGS. 1 to 10, an embodiment of the present invention will be explained below. FIG. 1 is a perspective view showing an appearance configuration of the electromagnetic relay according to the embodiment of the present invention. FIG. 2 is an exploded perspective view of the electromagnetic relay shown in FIG. 1. In this connection, the directions of front, rear, right, left, up and down are defined as follows for convenience and the constitution of each portion will be explained by using the directions.

As shown in FIG. 2, the electromagnetic relay of the present embodiment includes an electromagnetic relay assembling body 1; a housing 2 for accommodating the electromagnetic relay assembling body 1; and a cover 3 for covering an upper portion of the housing 2. The electromagnetic relay assembling body 1 includes a pair of right and left electromagnetic relay bodies 4; a printed board 5 arranged above the electromagnetic relay bodies 4; and tab terminals 6 protruded upward from an upper face of the printed board 5.

The housing 2 is a resinous component made of electrical insulating material, and is formed by integral molding. An upper face of this housing 2 is open, and the entire housing 2 is formed into a substantial box-shape. Flange portions 201 are provided at front and rear end portions in a lower end portion of the housing 2 so that the housing 2 is attachable to various parts through the flange portions 201 by using screws or the like. A step portion 202 is provided in a horizontal direction throughout the entire upper inside of the housing 2. Further, on front and rear insides of the housing 2 above the step portion 202, a step portion 203 is provided in a horizontal direction. Substantially rectangular through-holes 204 and 205 are provided at upper portions on right and left surfaces of the housing 2, and are separate from each other in the up-down direction.

The cover 3 is a resinous component made of an electrical insulating material, and is formed by integral molding. The cover 3 is formed into a substantially rectangular plate shape. Slit holes 301 are provided at positions respectively corresponding to the tab terminals 6 on the cover 3. Protruding portions 302 are provided at right and left end portions of the cover 3, and protrude downward and outside in the right-left direction. When the tab terminals 6 are made to penetrate the slit holes 301 and the protruding portions 302 are inserted into the upper through-holes 205 of the housing 2, the cover 3 is fixed onto an upper face of the housing 2, under the condition that the tab terminals 6 are protruded from the cover 3 as shown in FIG. 1. In this connection, rear side tab terminals 6*a* are tab terminals (coil terminal members) for applying voltage to the coil of the electromagnetic relay, and front side tab terminals 6*b* are contact tab terminals (contact terminal members) for electrifying the contacts of the electromagnetic relay.

Figure 3A:
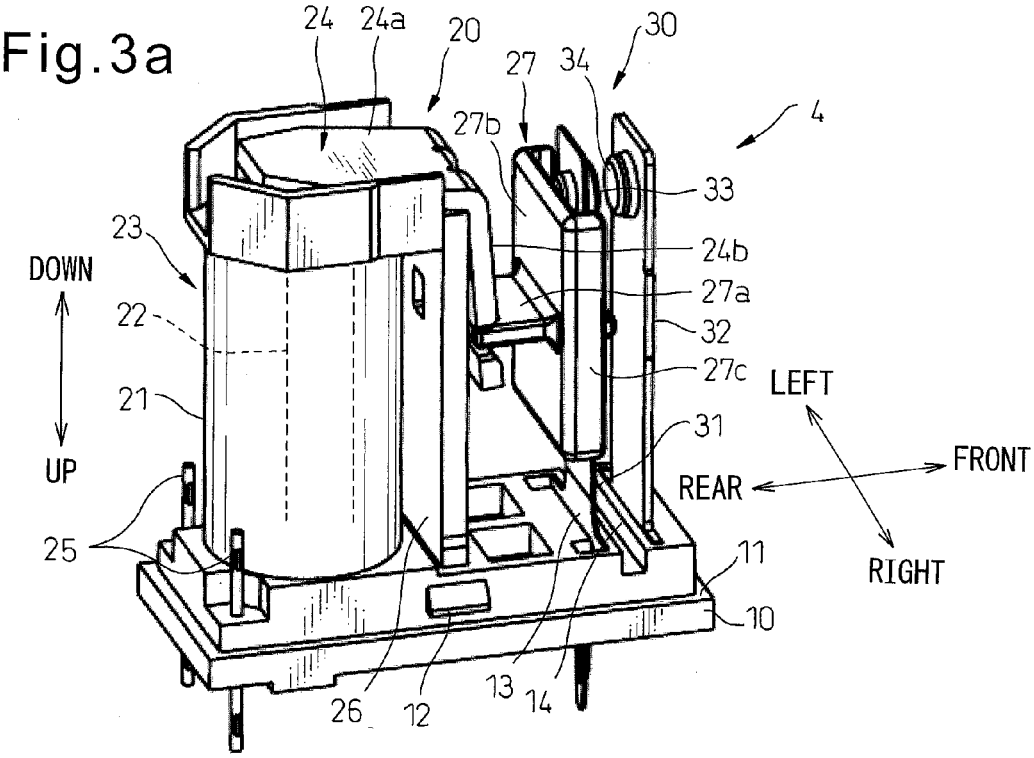
FIG. 3*a* is a perspective view showing a configuration of the electromagnetic relay body shown in FIG. 2.
Figure 3B:
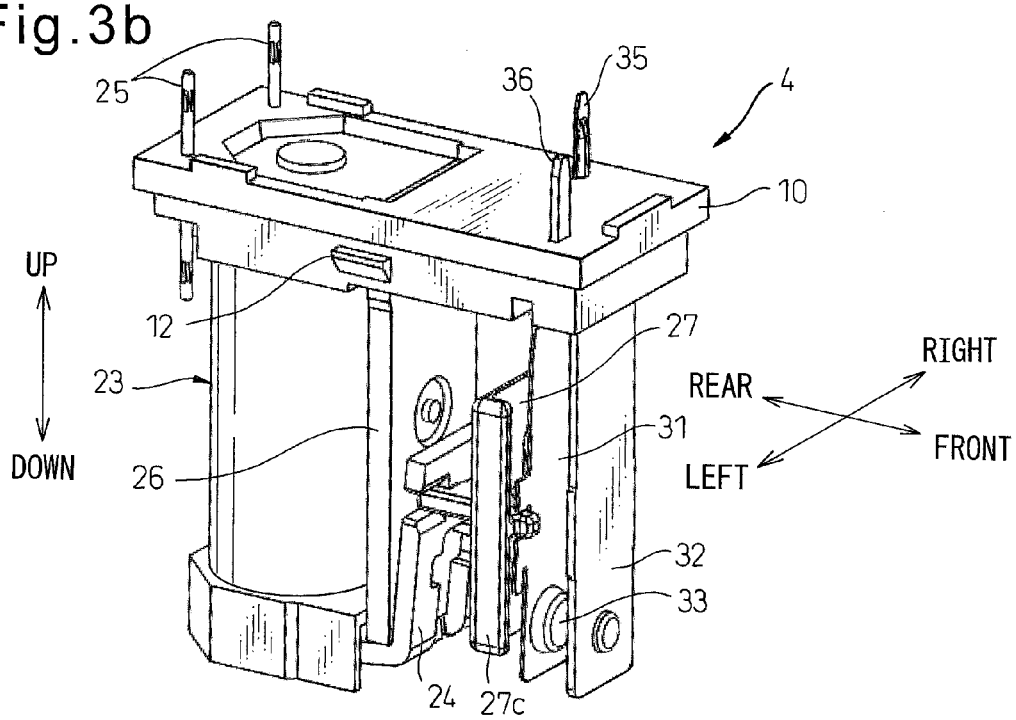
FIG. 3*b* is a perspective view showing a configuration of the electromagnetic relay body shown in FIG. 2.

The pair of right and left electromagnetic relay bodies 4 shown in FIG. 2 are formed into the same profile. FIGS. 3*a* and 3*b* are perspective views in which one of the electromagnetic relay bodies 4 are viewed from above and below. As shown in FIGS. 3*a* and 3*b*, the electromagnetic relay body 4 includes a base portion 10; an electromagnet device 20 attached to the base portion 10; and a contact portion 30 openable and closable according to an action of the electromagnet device 20.

The base portion 10 is a resinous component made of electrical insulating material, and is formed by means of integral forming. The entire base portion 10 is formed into a substantially rectangular block shape. The base portion 10 has a support portion for supporting the electromagnet device 20 and the contact portion 30. In this connection, the detailed explanations of the support portion will be omitted here. A step-shaped end face 11 is formed in a periphery of the base portion 10 so as to contact the step portion 202 (shown in FIG. 2) formed on the inside of the housing 2. Further, protruding portions 12 are provided on the right and left sides of the base portion 10 so as to be inserted into the lower side through-holes 204 (shown in FIG. 2).

The electromagnet device 20 includes an electromagnet 23 in which an iron core 22 is inserted into a cylindrical bobbin (not shown) to which a coil 21 is wound thereon, and an armature 24 attracted to or separated from the iron core 22 according to voltage applied to the coil 21. A pair of right and left coil terminals 25 are provided at the rear end portion of the base portion 10 so as to penetrate the base portion 10 in the up-down direction. Both end portions of a winding wire of the coil 21 are connected to lower end portions of the coil terminals 25, so that voltage is applied to the coil 21 through the coil terminals 25.

The bobbin of the electromagnet 23 is arranged at a rear portion of the base portion 10, and the iron core 22 is accommodated inside the bobbin in the up-down direction. The armature 24 is a substantially L-shaped plate member made of soft magnetic material such as iron.

The armature 24 includes a horizontal portion 24*a* arranged facing a lower end face of the iron core 22, and a vertical portion 24*b* extending in a substantially vertical direction from a front end portion of the horizontal portion 24*a* to the base portion 10. A substantially rectangular yoke 26 is arranged between the coil 21 of the electromagnet 23 and the vertical portion 24*b* of the armature 24. The yoke 26 extends in the up-down direction. A width of the yoke 26 in the right left direction is substantially the same as that of the armature 24. The yoke 26 is supported by the base portion 10. The armature 24 capable of oscillating is supported on a lower end face of the yoke 26.

A card 27 is arranged in front of the vertical portion 24*b* of the armature 24. The card 27 is an insulating body made of electrical insulating material. The card 27 integrally includes a horizontal portion 27*a* extending in the front-rear direction; a vertical portion 27*b* extending in the up-down direction from a rear end of the horizontal portion 27*a*; and a side wall portion 27*c* extending forward from right and left end portions of the vertical portion 27*b*. A rear end portion of the horizontal portion 27*a* is connected to the vertical portion 24*b* of the armature 24 so that the card 27 is moved in the front-rear direction according to oscillation of the armature 24.

The contact portion 30 includes a movable contact plate member 31 arranged in front of the vertical portion 27*b* of the card 27, and a fixed contact plate member 32 arranged in front of the movable contact plate member 31. The fixed contact plate member 32 is composed of, for example, a conductive plate member formed by die-cutting a copper plate into a predetermined shape. The movable contact plate member 31 is composed of, for example, a conductive plate member formed by die-cutting a phosphor bronze sheet for spring into a predetermined shape. The movable contact plate member 31 and the fixed contact plate member 32 are plate members formed widely in the right and left direction. These members 31 and 32 are extended in the up-down direction, and a width of the plate member 31 in the right-left direction is substantially the same as that of the plate member 32. The vertical portion 27*b* of the card 27 and the movable contact plate member 31 are opposed to each other, and the movable contact plate member 31 and the fixed contact plate member 32 are also opposed to each other. The movable contact plate member 31 is connected to a pair of right and left side wall portions 27*c* of the card 27 at a somewhat lower portion of its center.

The movable contact plate member 31 and the fixed contact plate member 32 are respectively supported by the support portions 13 and 14 formed in the base portion 10. It is not necessary that each plate member 31 and 32 has a constant width all over the length. For example, the width of each plate member 31, 32 is extended in the support portions 13, 14. A conductive movable contact 33 is fixed on a front face at a lower end portion of the movable contact plate member 31, and a conductive fixed contact 34 is fixed on a rear face at a lower end portion of the fixed contact plate member 32, opposed to the conductive movable contact 33.

A terminal 35 for movable contact 33 is provided at an upper end of the movable contact plate member 31. A terminal 36 for fixed contact 34 is provided at an upper end of the fixed contact plate member 32. These terminals 35 and 36 are formed in such a manner that an upper end portion of each plate member 31 and 32 is formed into a long and slender shape. These terminals 35 and 36 respectively penetrate the base portion 10 and protrude upward. When a profile of the upper end portion of each plate member 31 and 32 is appropriately formed, each terminal 35 and 36 can be protruded from an arbitrary position in the base portion 10. As shown in FIG. 3*b*, in the present embodiment, the terminal 36 protrudes from the left front end portion of the base portion 10, and the terminal 35 protrudes from a right oblique rear portion of the terminal 36.

In this electromagnetic relay body 4, when operation voltage is applied to the coil 21 of the electromagnet 23, the electromagnet device 23 is operated, and the armature 24 is oscillated round the lower end of the yoke 26 by a magnetic attraction force of the electromagnet device 23. By this oscillation of the armature 24, the card 27 is pushed forward, and the movable contact plate member 31 is elastically bent and deformed forward about the support portion 13 of the base portion 10, and therefore, the movable contact 33 comes into contact with the fixed contact 34. On the other hand, when the operation voltage applied to the coil 21 is released, the electromagnet device 23 becomes a non-active state, and the movable contact plate member 31 is released from a pushing force acting to the front direction. As a result, the movable contact plate member 31 is returned to an initial position shown in FIGS. 3*a* and 3*b* by a function as a leaf spring, and therefore, the movable contact 33 is separated from the fixed contact 34.

Figure 4:
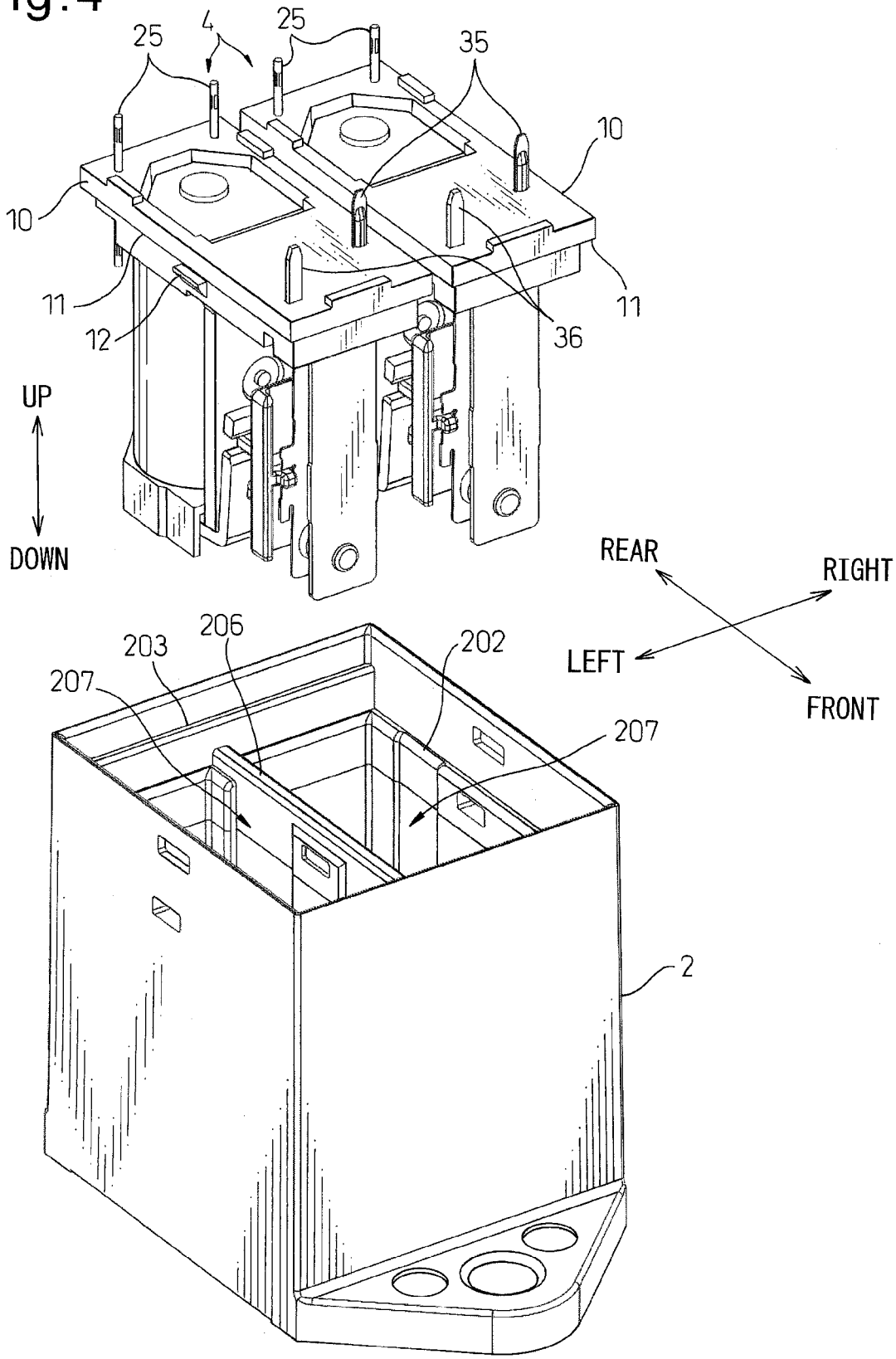
FIG. 4 is a perspective view showing a state of accommodation in which a pair of electromagnetic relay bodies shown in FIG. 2 are accommodated in a housing.

FIG. 4 is a perspective view showing a state in which the pair of electromagnetic relay bodies shown in FIG. 2 are accommodated in the housing. Inside the housing 2, a bulkhead 206 is provided along the front-rear direction at the center of the right-left direction. An inside space of the housing 2 is divided into two accommodation spaces 207 by the bulkhead 206. A pair of electromagnetic relay bodies 4 are respectively separately accommodated into the accommodation spaces 207 from above, as shown in the drawing. At this time, the end face 11 of the base portion 10 comes into contact with the step portion 202 of the housing 2 and the protruding portion 12 is inserted into the through-hole 204, so that the electromagnetic relay body 4 can be supported in the housing 2. When the electromagnetic relay body 4 is accommodated in the housing 2, four coil terminals 25, two terminals 35 for movable contacts 33 and two terminals 36 for fixed contacts 34 are respectively protruded upward.

Figure 5:
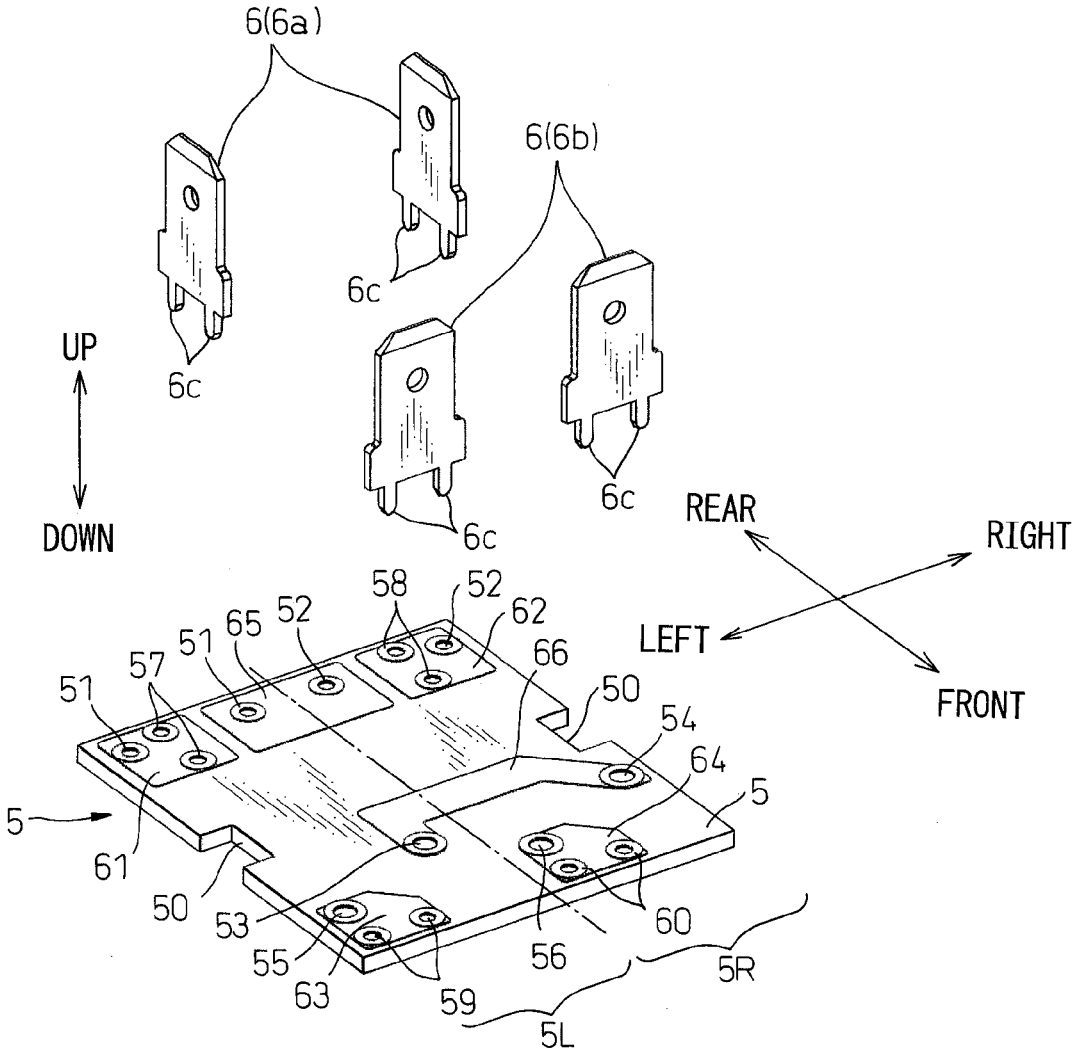
FIG. 5 is a perspective view showing constitution of a printed board and tab terminals shown in FIG. 2.

In the present embodiment, these terminals 25, 35 and 36 are connected to the printed board 5 arranged above the base portion 10. FIG. 5 is a perspective view showing a configuration of the printed board 5 and the tab terminals 6. The printed board 5 is a substantial rectangular plate member made of electrically insulating material. Cut-out portions 50 are respectively provided on the right and left side faces of the printed board 5. The tab terminals 6 (a coil tab terminal 6*a* and a contact tab terminal 6*b*) are composed of an electrical conductive plate member. A pair of connecting portions 6*c* for connecting to the printed board 5 is formed at the lower end portion of each tab terminal 6. A pair of coil tab terminals 6*a* are arranged at the rear end portion of the printed board 5, opposed to each other. A pair of contact tab terminals 6*b* are arranged at the front end portion of the printed board 5 on the same straight line in the right-left direction.

A plurality of through-holes for connecting to terminals are provided at the printed board 5. In this case, given that the printed board 5 is divided into two regions 5L and 5R corresponding to the right and left electromagnetic relay bodies 4, the left region 5L of the printed board 5 includes a pair of through-holes 51 corresponding to the positions of the coil terminals 25; a through-hole 53 corresponding to the position of the terminal 35; a through-hole 55 corresponding to the position of the terminal 36; a pair of through-holes 57 corresponding to the positions of the connecting portions 6*c* of the coil tab terminal 6*a*; and a pair of through-holes 59 corresponding to the positions of the connecting portions 6*c* of the contact tab terminal 6*b*. In this case, the pair of through-holes 57 are provided between the pair of through-holes 51, and close to the left through-hole 51. The pair of through-holes 59 are provided in front of the through-hole 55, and close to the through-hole 55.

In the same manner, the right region 5R of the printed board 5 includes a pair of through-holes 52 corresponding to the positions of the coil terminals 25; a through-hole 54 corresponding to the position of the terminal 35; a through-hole 56 corresponding to the position of the terminal 36; a pair of through-holes 58 corresponding to the positions of the connecting portions 6*c* of the coil tab terminal 6*a*; and a pair of through-holes 60 corresponding to the positions of the connecting portions 6*c* of the contact tab terminal 6*b*. In this case, the pair of through-holes 58 are provided between the pair of through-holes 52, and close to the right through-hole 52. The pair of through-holes 60 are provided in front of the through-hole 56, and close to the through-hole 56.

Corresponding to these through-holes 51 to 60, a predetermined circuit pattern is formed on an upper face of the printed board 5 by an electrical conductive body. The predetermined circuit pattern includes an electrical conductive portion 61 containing the left through-hole 51 and the pair of through-holes 57; an electrical conductive portion 62 containing the right through-hole 52 and the pair of through-holes 58; an electrical conductive portion 63 containing the through-hole 55 and the pair of through-holes 59; an electrical conductive portion 64 containing the through-hole 56 and the pair of through-holes 60; an electrical conductive portion 65 containing the right through-hole 51 and the left through-hole 52; and an electrical conductive portion 66 containing the through-hole 53 and the through-hole 54. In this case, the electrical conductive portion 66 is formed into a pattern bent backward so as to be separate from the electrical conductive portion 64.

When the printed board 5 is accommodated in the housing 2, the tab terminals 6 are previously soldered onto the printed board 5. That is, the connecting portions 6*c* of the tab terminals 6 are respectively inserted into the through-holes 57 to 60 and soldered onto the printed board 5. After that, the printed board 5 integrated with the tab terminals 6 is accommodated in the housing 2. Under the condition that the printed board 5 is accommodated, a lower face of the printed board 5 comes into contact with the step portion 203 on the front and rear inner side faces of the housing 2. Therefore, the printed board 5 is supported in the housing 2 which is separate from the base portion 10. At this time, the coil terminals 25 penetrate the through-holes 51 and 52 of the printed board 5, the terminals 35 penetrate the through-holes 53 and 54, and the terminals 36 penetrate the through-holes 55 and 56. As a result, these terminals 25, 35 and 36 protrude from an upper face of the printed board 5.

The terminals 25, 35 and 36 protruding from the printed board 5 are soldered to the electrical conductive portions 61 to 66 to form the terminal connecting circuit. After that, the cover 3 is attached to an upper portion of the housing 2. At this time, the tab terminals 6 penetrate the slit holes 301 formed on the cover 3, and the protruding portions 302 of the cover 3 pass through the cut-out portions 50 of the printed board 5 and are inserted into the through-holes 205 of the housing 2. In this way, assembling of the electromagnetic relay (shown in FIG. 1) is completed. As a result, electric parts such as a printed board are connected to the tab terminals 6 of the completed electromagnetic relay.

Figure 6:
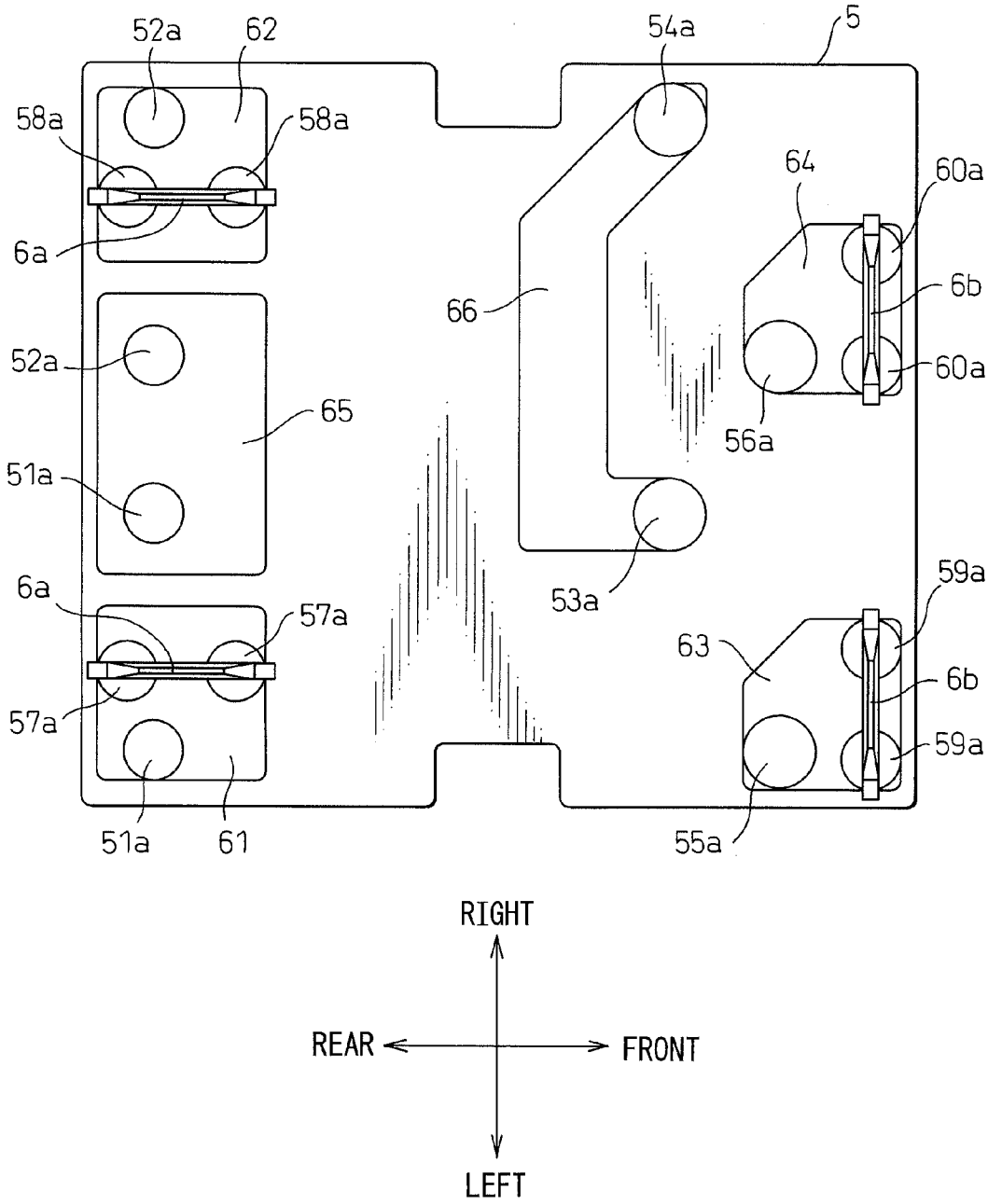
FIG. 6 is a plan view showing an internal structure of the electromagnetic relay shown in FIG. 1, that is.

A principal action of the electromagnetic relay according to the present embodiment will be explained below. FIG. 6 is a view in which the electromagnetic relay assembling body 1 (shown in FIG. 2) accommodated in the housing 2 is viewed from above. In the view, reference marks 51*a* to 60*a* are the soldered portions (the terminal connecting portions) of the terminals in the through-holes 51 to 60. When the electromagnetic relay is in a non-active state, electric current does not flow through the coil tab terminals 6*a*, and therefore, the coil 21 of the electromagnet 23 is put into a non-excited state. Accordingly, the movable contact 33 is set at the initial position and separated from the fixed contact 34, so that a flow of an electric current to the contact tab terminals 6*b* is shut off.

When the electromagnetic relay is put into an active state, an electric current flows from one of the coil tab terminals 6*a*, for example, from the left coil tab terminal 6*a* to the electrical conductive portion 61 of the printed board 5, the left side coil 21, the electrical conductive portion 65, the right side coil 21, the electrical conductive portion 62 and the other (the right) coil tab terminal 6*a* in this order. That is, the electric current flows to the right and left coils 21 in series. Thus, the right and left coils 21 are respectively excited, and each armature 24 is attracted to the iron core 22 of the electromagnet 23, and therefore, the right and left movable contacts 33 are respectively in contact with the fixed contacts 34.

As a result, an electric current flows from one of the contact tab terminals 6*b*, for example, from the left contact tab terminal 6*b* to the electrical conductive portion 63 of the printed board 5, the fixed contact 34 of the left side electromagnetic relay body 4, the movable contact 33 coming into contact with the fixed contact 34, the electrical conductive portion 66, the movable contact 33 of the right side electromagnetic relay body 4, the fixed contact 34 coming into contact with the movable contact 33, the electrical conductive portion 64 and the other (the right side) contact tab terminal 6*b* in this order. That is, the electric current flows to the contacts 33, 34 of the right and left electromagnetic relay bodies 4 in series.

In the present embodiment, when the setting of the circuit pattern of the printed board 5 is changed, an arrangement of the tab terminals 6 can be easily changed without changing the configuration of the electromagnetic relay body 4. This matter will be explained below.

Figure 7:
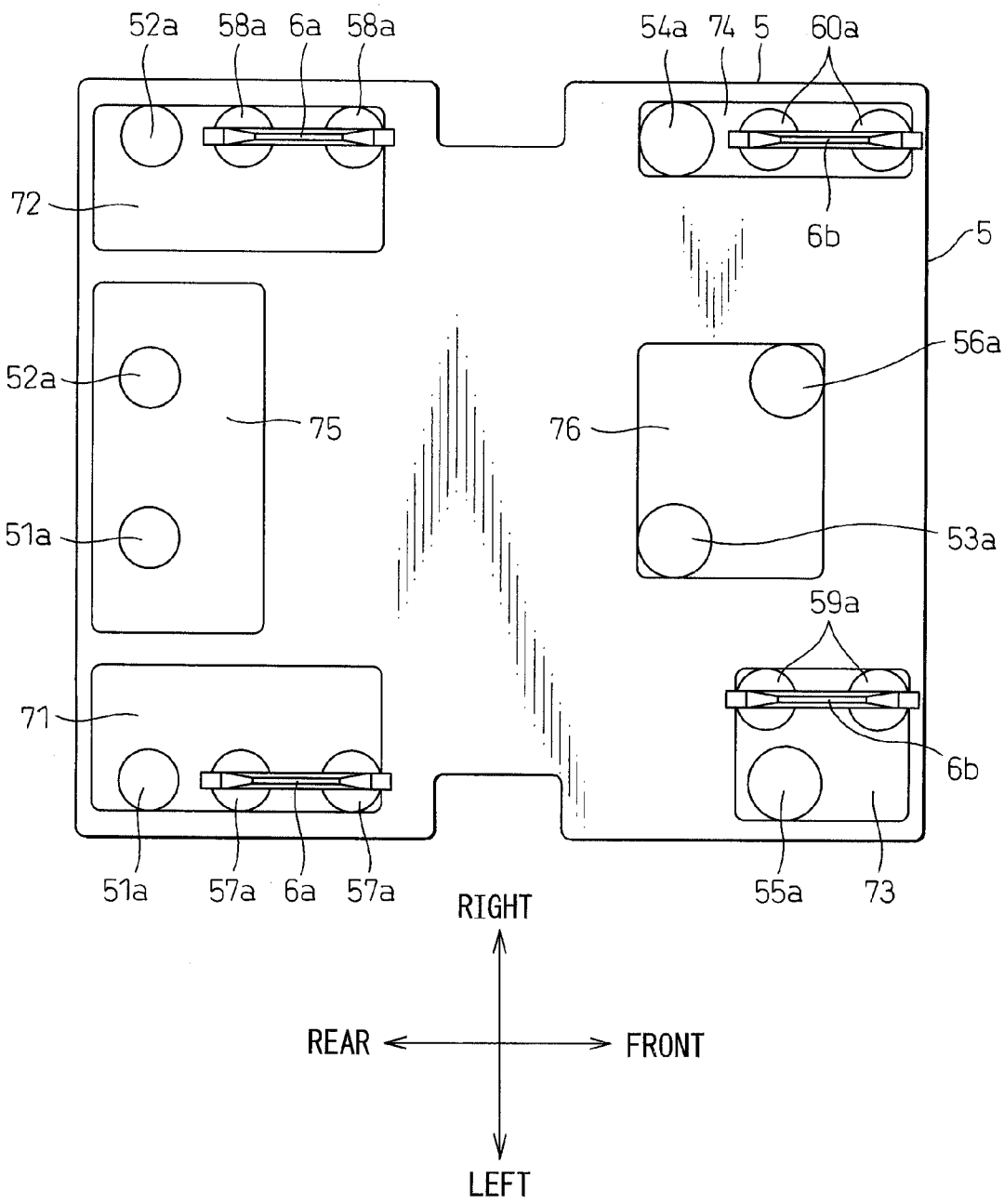
FIG. 7 is a view showing a first variation of the electromagnetic relay shown in FIG. 6.

FIG. 7 is a view showing a variation (a first variation) of FIG. 6 in which the arrangement of the tab terminals 6 is changed. In FIG. 7, the terminal connecting portions 57*a* and 58*a* of the right and left coil tab terminals 6*a* are respectively located in front of the terminal connecting portions 51*a* and 52*a*, the terminal connecting portions 59*a* of the left contact tab terminal 6*b* is located on the right side of the terminal connecting portion 55*a*, and the terminal connecting portions 60*a* of the right contact tab terminal 6*b* is located in front of the terminal connecting portion 54*a*. Positions of the terminal connecting portions 51*a* to 56*a* of the coil terminals 25, the terminals 35 and the terminals 36 are the same as those shown in FIG. 6.

The electrical conductive portion 71 in FIG. 7 connects the left terminal connecting portion 51*a* with the pair of terminal connecting portions 57*a*, the electrical conductive portion 72 connects the right terminal connecting portion 52*a* with the pair of terminal connecting portions 58*a*, the electrical conductive portion 73 connects the terminal connecting portion 55*a* with the pair of terminal connecting portions 59*a* and the electrical conductive portion 75 connects the right side terminal connecting portion 51*a* with the left side terminal connecting portion 52*a*. That is, the fundamental configuration of the electrical conductive portions 71, 72, 73 and 75 is the same as that of the electrical conductive portions 61, 62, 63 and 65 shown in FIG. 6.

On the other hand, the electrical conductive portion 74 connects the terminal connecting portion 54*a* with the pair of terminal connecting portions 60*a*, and the electrical conductive portion 76 connects the terminal connecting portion 53*a* with the terminal connecting portion 56*a*. Thus, in the same manner as that shown in FIG. 6, the circuit is formed, in which the right and left coils 21 are connected to each other in series through the printed board 5 and the contacts 33 and 34 of the right and left electromagnetic relay bodies 4 are connected to each other in series.

According to the present embodiment, the following operational effects can be exhibited.

(1) The terminal connecting circuit is formed on the printed board 5, in such a manner that the connecting portions 6*c* of the tab terminals 6 are connected to the printed board 5 and that four coil terminals 25, a pair of terminals 35 for movable contacts 33 and a pair of terminals 36 for fixed contacts 34 are respectively connected to the printed board 5. Therefore, in the electromagnetic relay including a plurality of coil terminals 25, terminals 35 and terminals 36, the arrangement of the tab terminals 6 can be easily changed as shown in FIGS. 6 and 7 without changing the configuration of the electromagnetic relay body 4.

(2) The terminals 35 and terminals 36 of a pair of electromagnetic relay bodies 4 are connected to each other in series through the printed board 5. Therefore, a contact gap can be increased.

(3) The terminal arrangement can be changed by using the tab terminals 6 of the same profile without changing the profile of the tab terminal 6. Therefore, the number of parts can be prevented from increasing.

(4) The electromagnetic relay body 4 is supported by the housing 2, in such a manner that the base portion 10 of the electromagnetic relay body 4 is contacted with the step portion 202 of the housing 2 and the protruding portion 12 of the base portion 10 is inserted into the through-hole 204 of the housing 2. Therefore, it can be prevented that a load due to a gravity of the coil 21 or the like is applied to the terminal connecting portion of the printed board 5.

(5) By using the protruding portions 12 and the through-holes 204, the electromagnetic relay body 4 can be easily fixed to the housing 2 without using a means of adhesion or the like.

(6) After a pair of electromagnetic relay bodies 4 are accommodated in the housing 2, the printed board 5, onto which the tab terminals 6 are previously fixed, is placed above the electromagnetic relay body 4. Furthermore, under the condition that the coil terminals 25, the terminals 35 and the terminals 36 are protruded from the printed board 5, the terminals 25, 35 and 36 are soldered onto the printed board 5. Accordingly, the electromagnetic relay can be easily assembled.

In the above embodiment, the terminals 35 (a first movable contact member and a second movable contact member) of a pair of movable contact plate members 31 and the terminals 36 (a first fixed contact member and a second fixed contact member) of a pair of fixed contact plate members 32 are respectively electrically connected to the printed board 5, and a pair of contact tab terminals 6*b* (a first contact terminal member and a second contact terminal member) are electrically connected to the printed board 5. Furthermore, the circuit is formed, in such a manner that the fixed contact 34 (a first fixed contact) of one (for example, on the left side) of the fixed contact members 32, the movable contact 33 (a first movable contact) of one of the movable contact plate members 31, the movable contact 33 (a second movable contact) of the other movable contact plate member 31 and the fixed contact 34 (a second fixed contact) of the other fixed contact member 32 are connected to each other in series. However, the configuration of the terminal connecting circuit is not limited to the embodiment described above.

Figure 8:
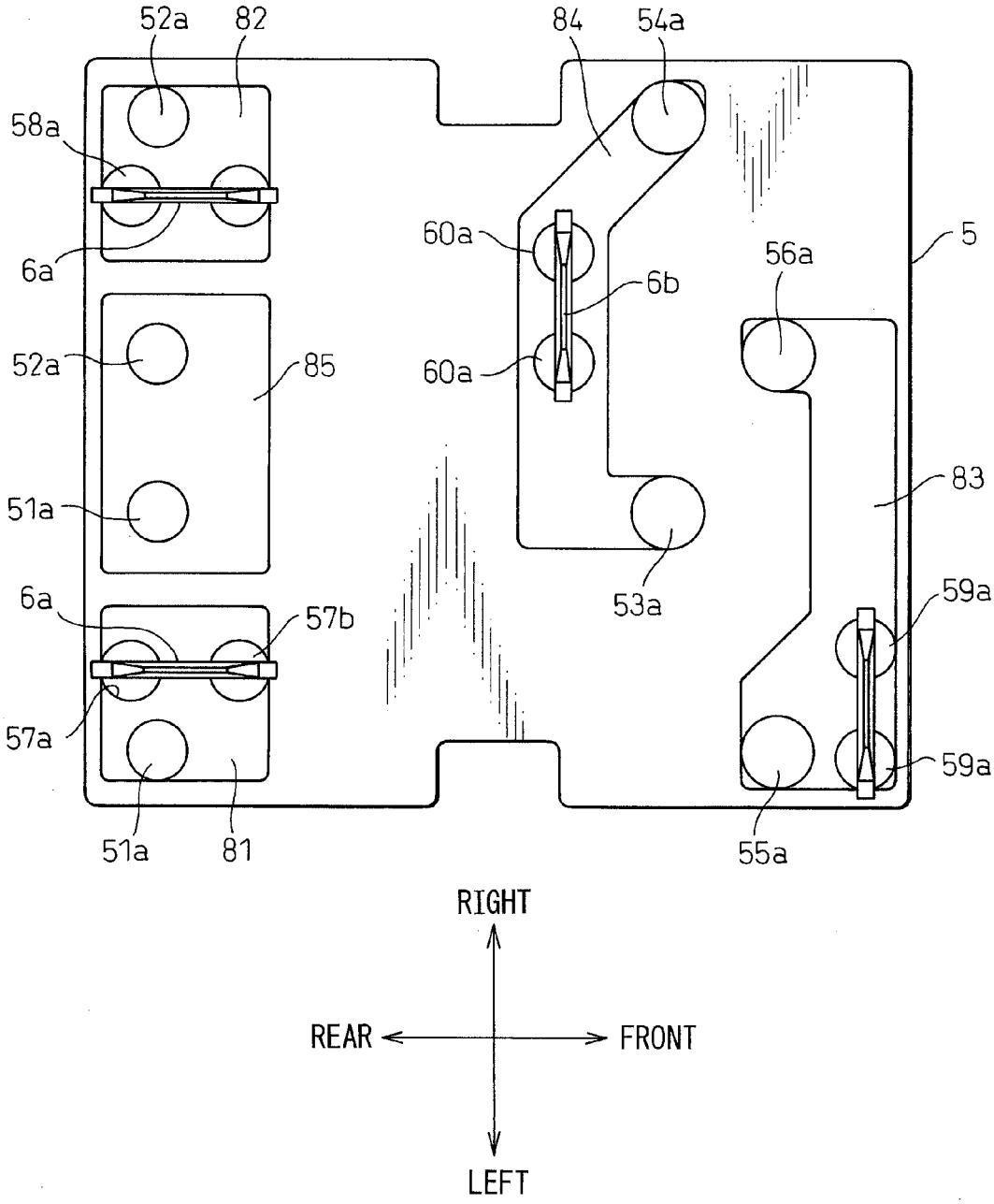
FIG. 8 is a view showing a second variation of the electromagnetic relay shown in FIG. 6.

FIG. 8 is a view showing a variation (a second variation of FIG. 6) of the terminal connecting circuit. When FIG. 8 is compared with FIG. 6, in the configuration shown in FIG. 8, a pair of terminal connecting portions 60*a* of the contact tab terminals 6*b* are located at the middle in the right-left direction of the terminal connecting portions 53*a* and 54*a*, and at a little rearward position of the terminal connecting portions 53*a* and 54*a*. The electrical conductive portions 81, 82 and 85 shown in FIG. 8 are formed in the same manner as that of the electrical conductive portions 61, 62 and 65 shown in FIG. 6. On the other hand, in the electrical conductive portion 83, the terminal connecting portions 55*a* and 56*a* to which the right and left terminals 36 are connected and a pair of terminal connecting portions 59*a* of the contact tab terminal 6*b* are connected to each other. In the electrical conductive portion 84, the terminal connecting portions 53*a* and 54*a* to which the right and left terminals 35 are connected and a pair of terminal connecting portions 60*a* of the contact tab terminal 6*b* are connected to each other.

Therefore, when the electromagnetic relay is put into the active state, an electric current flows from one (for example, the left side) of the contact tab terminals 6*b* to the electrical conductive portion 83 of the printed board 5, the fixed contacts 34 of the right and left electromagnetic relay bodies 4, the movable contacts 33, the electrical conductive portion 84 and the other (the right side) contact tab terminal 6*b* in this order. That is, the electric current flows to the contacts 33 and 34 of the right and left electromagnetic relay bodies 4 in parallel. In this way, when a parallel circuit is formed through the printed board 5, it is possible to increase an electrifying capacity of the contact.

In FIG. 6, the circuit is formed, in such a manner that a pair of coils 21 (a first coil section and a second coil section) are electrically connected to the printed board 5 through the coil terminals 25, and a pair of coil tab terminals 6*a* (a first coil terminal member and a second coil terminal member) are electrically connected to the printed board 5, so that a pair of coils 21 are connected to each other in series by the printed board 5. However, the configuration of the circuit is not limited to the embodiment described above.

Figure 9:
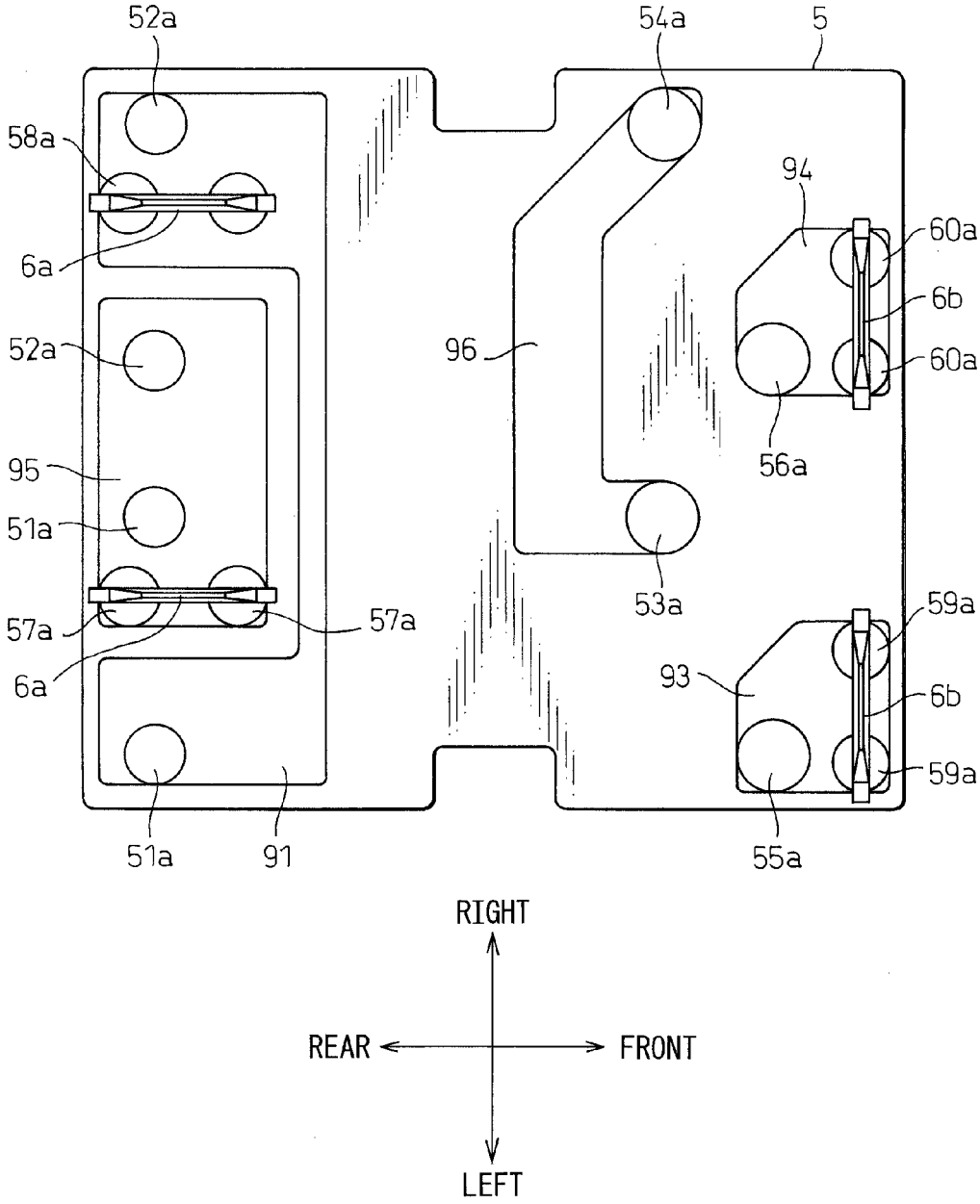
FIG. 9 is a view showing a third variation of the electromagnetic relay shown in FIG. 6.

FIG. 9 is a view showing a variation example (a third variation example of FIG. 6) of the terminal connecting circuit. When FIG. 9 is compared with FIG. 6, in FIG. 9, a pair of terminal connecting portions 57*a* of one of the coil tab terminals 6*a* are arranged close to the right terminal connecting portion 51*a* between the right and left terminal connecting portions 51*a*. The electrical conductive portions 93, 94 and 96 shown in FIG. 9 are respectively formed in the same manner as the electrical conductive portions 63, 64 and 66 shown in FIG. 6. On the other hand, in the electrical conductive portion 91, the terminal connecting portion 51*a* to which the left coil terminal 25 of the left electromagnetic relay body 4 is connected, the terminal connecting portion 52*a* to which the right coil terminal 25 of the right electromagnetic relay body 4 is connected, and the terminal connecting portions 58*a* of the coil tab terminal 6*a* are connected to each other. In the electrical conductive portion 95, the terminal connecting portion 51*a* to which the right coil terminal 25 of the left electromagnetic relay body 4 is connected, the terminal connecting portion 52*a* to which the left coil terminal 25 of the right electromagnetic relay body 4 is connected, and the terminal connecting portions 57*a* of the coil tab terminal 6*a* are connected to each other.

As a result, when the electromagnetic relay is put into an active state, an electric current flows from one (for example, the left) of the coil tab terminals 6*a* to the electrical conductive portion 95 of the printed board 5, the right and left coils 21, the electrical conductive portion 91 and the other (the right) coil tab terminal 6*a* in this order. That is, the electric current flows in the right and left coils 21 in parallel.

Figure 10:
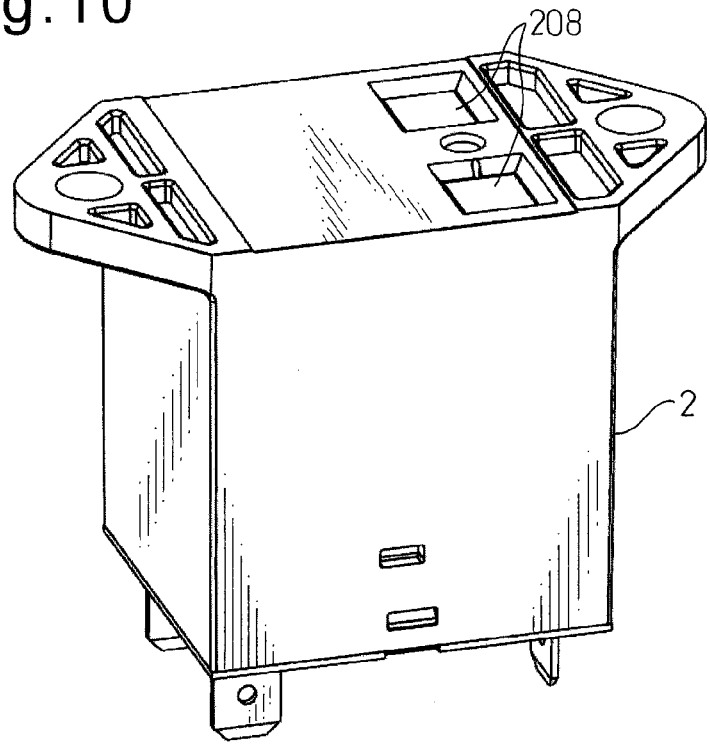
FIG. 10 is a view showing an example in which a magnet is attached to a housing of the electromagnetic relay according to the embodiment of the present invention.
Figure 10:
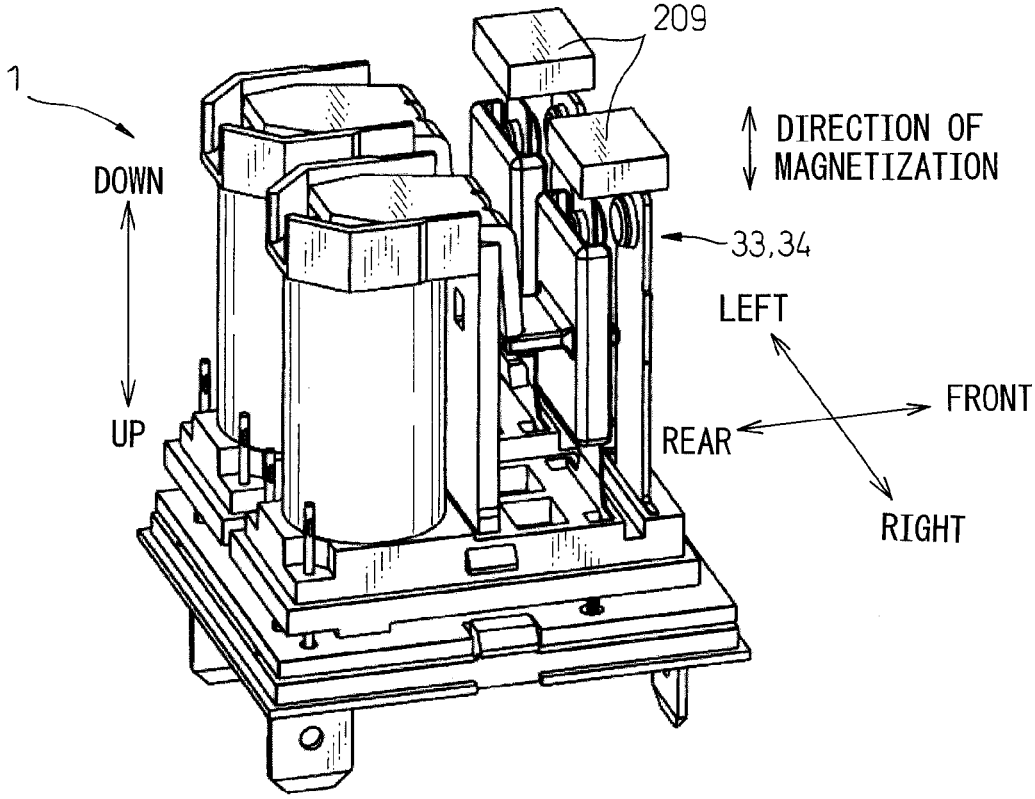

In order to shut off arc discharge generated when the electromagnetic relay is put into a non-active state, a permanent magnet may be provided close to the contacts 33 and 34. FIG. 10 is a view showing an example of the arrangement of the permanent magnet. In FIG. 10, a pair of substantially rectangular through-holes 208 are opened in the bottom portion of the housing 2 and the permanent magnet 209 is attached to each through-hole 208. Therefore, in a state in which the electromagnetic relay assembling body 1 is accommodated in the housing 2, the permanent magnet 209 is located below each contact 33 and 34 as shown in the drawing. The magnet 209 generates a magnetic force in a direction (the up-down direction) perpendicular to the direction (the front-rear direction) in which the movable contact 33 and the fixed contact 34 are opposed to each other. Therefore, it is easy to shut off an arc discharge generated between the contacts 33 and 34.

In the embodiment described above, a pair of electromagnetic relay bodies 4 are accommodated in the housing 2 and electrically connected to each other through the printed board 5. However, not less than three electromagnetic relay bodies 4 may be electrically connected to each other through the printed board 5, and the number of the terminals 25, 35 and 36 connected to each other through the printed board 5 is not limited to the embodiment described above. The protruding portion 12 of the base portion 10 is inserted into the through-hole 204 of the housing 2 so as to support the base portion 10 (base member). However, the configuration of the support portion is not limited to the embodiment described above.

According to the present invention, a plurality of fixed contact members, a plurality of movable contact members and a plurality of contact terminal members are respectively connected to the printed board, so that at least one of the fixed contact members and the movable contact members can be connected to the contact terminal members through the printed board. Therefore, an arrangement of the terminal members can be easily changed.

While the present invention has been described with reference to the preferred embodiments thereof, it will be understood, by those skilled in the art, that various modifications and changes may be made thereto without departing from the scope of the appended claims.

The invention claimed is:

1. An electromagnetic relay comprising:

an electromagnet device having an electromagnet in which an iron core is attached to a bobbin with a coil wound thereon, and an armature attracted to or separated from the iron core according to voltage applied to the coil;

a contact portion openable and closable according to a movement of the armature, the contact portion including a first fixed contact member in which a first fixed contact is arranged, a second fixed contact member in which a second fixed contact is arranged, a first movable contact member in which a first movable contact opposed to the first fixed contact is arranged and a second movable contact member in which a second movable contact opposed to the second fixed contact is arranged, wherein the first and second movable contact members operate according to a movement of the armature;

a printed board to which the first and second fixed contact members and the first and second movable contact members are respectively electrically connected, including an electrical conductive portion electrically connecting the first movable contact member to the second movable contact member; and a first contact terminal member and a second contact terminal member, which are electrically connected respectively to the first fixed contact member and the second fixed contact member through the printed board and protrude from the printed board and adapted to be connected to electrical parts provided outside;

wherein the printed board forms a terminal connecting circuit in which, when the first fixed contact and the first movable contact are in contact with each other and the second fixed contact and the second movable contact are in contact with each other, mutually contacting first fixed and movable contacts and mutually contacting second fixed and movable contacts are connected to each other in series between the first contact terminal member and the second contact terminal member.

2. The electromagnetic relay according to claim 1, wherein the fixed contact members comprise a first fixed contact member in which a first fixed contact is arranged and a second fixed contact member in which a second fixed contact is arranged;

wherein the movable contact members comprise a first movable contact member in which a first movable contact is arranged and a second movable contact member in which a second movable contact is arranged;

wherein the contact terminal members comprise a first contact terminal member and a second contact terminal member, protruding from the printed board; and wherein the printed board forms a terminal connecting circuit so that the first fixed contact, the first movable contact, the second fixed contact and the second movable contact are connected to each other in parallel between the first contact terminal member and the second contact terminal member when the first fixed contact and the first movable contact are in contact with each other and when the second fixed contact and the second movable contact are in contact with each other.

3. The electromagnetic relay according to claim 1, wherein the coil comprises a first coil section and a second coil section respectively electrically connected to the printed board.

4. The electromagnetic relay according to claim 3, further comprising a first coil terminal member and a second coil terminal member, electrically connected to the printed board, and capable of applying voltage to the coil, wherein a terminal connecting circuit is formed on the printed board so that the first coil section and the second coil section are connected to each other in series or in parallel between the first coil terminal member and the second coil terminal member.

5. The electromagnetic relay according to claim 1, further comprising a magnet generating a magnetic force in a direction perpendicular to a direction in which the fixed contacts and the movable contacts are opposed to each other.

6. The electromagnetic relay according to claim 1, further comprising a base member for supporting the electromagnet device and the contact portion, wherein the first and second fixed contact members and the first and second movable contact members respectively penetrate the base member and connect to the printed board.

7. The electromagnetic relay according to claim 6, further comprising a housing for accommodating the electromagnet device and the contact portion, wherein the housing includes a support portion for supporting the base member.

* * * * *